US005590855A

United States Patent [19]

Kato et al.

[11] Patent Number: 5,590,855

[45] Date of Patent: Jan. 7, 1997

[54] TRAIN DETECTION DEVICE FOR RAILROAD MODELS AND TRAIN CROSSING CONTROL APPARATUS UTILIZING THE TRAIN DETECTION DEVICE

[76] Inventors: Ryochi Kato; Umeko Kato, both of 2, Yachiyodai-Nishi 6-chome, Yachiyo-shi, Chiba-ken 276; Tomohiko Kato, 206, Kami-Arai 880-5, Tokorozawa-shi, Saitama-ken 359; Hideto Kato, Horinouchi 2512, Hachioji-shi, Tokyo 192-03; Teruko Ichizuka, 10, Yachiyodai-Higashi 4-chome, Yachiyo-shi, Chiba-ken 276, all of Japan

[21] Appl. No.: 274,623

[22] Filed: Jul. 12, 1994

[51] Int. Cl.[6] ..... B61L 3/08

[52] U.S. Cl. ..... 246/202; 246/122 R; 246/220; 104/DIG. 1; 340/941

[58] Field of Search ..... 246/122 R, 125, 246/126, 127, 202, 220, 293; 104/DIG. 1, 296; 364/424.01; 361/280; 340/901, 933, 941

[56] References Cited

U.S. PATENT DOCUMENTS

| | | | |
|---|---|---|---|
| 4,470,008 | 9/1984 | Kato | 324/61 |
| 4,581,943 | 4/1986 | Feller | 73/861.05 |
| 5,253,830 | 10/1993 | Nayer et al. | 246/162 |
| 5,297,484 | 3/1994 | Piserchia et al. | 104/DIG. 1 |
| 5,451,017 | 9/1995 | Graff et al. | 246/220 |

FOREIGN PATENT DOCUMENTS

| | | |
|---|---|---|
| 296361 | 10/1992 | Japan . |
| 292133 | 10/1992 | Japan . |

*Primary Examiner*—S. Joseph Morano
*Attorney, Agent, or Firm*—Marger, Johnson, McCollom & Stolowitz, P.C.

[57] ABSTRACT

A train detection device for use in railroad models is provided with a capacitance type sensor which detects the close approach or passage of a train by responding to capacitance of the train. By using the capacitance type sensor, the train detection device becomes a non-contact type detection device, which avoids the kind of damage that can occur with contact type detectors. The train detection device is applied to a train crossing control apparatus for use in railroad models equipped with a crossing gate, a warning signal, and a controlling device for controlling the operations of the crossing gate and the warning signal. The controlling device comprises the capacitance type sensors each provided on either side of the crossing so as to define an activation region, each of the sensors detecting the approach or passage of a train by responding to the capacitance thereof, the capacitance type crossing sensor that detects the approach or passage of a train through the crossing, and a reverse motion detection device that detects reversal of the direction of motion of the train. With these elements the train crossing control apparatus is able to determine the position of the train within the activation region, so as to accurately and reliably control the operations of the crossing gate and warning signal irregardless of any changes in the direction of motion thereof.

4 Claims, 11 Drawing Sheets

Program I (Standerd Operation Program)

Program II (Reverse Motion Operation Program)

TRAIN DETECTION DEVICE FOR RAILROAD MODELS AND TRAIN CROSSING CONTROL APPARATUS UTILIZING THE TRAIN DETECTION DEVICE

BACKGROUND OF THE INVENTION

1. Field of the Invention

The present invention relates to a train detection device for railroad models, and more specifically relates to a train detection device that detects such things as the close approach of a train to a crossing and the passage of a train through the crossing in order to activate and deactivate train crossing gates, warning signal devices and the like, and is particularly suited for railroad models in the "HO" and "N" internationally standardized scales. The present invention further relates to a train crossing control apparatus utilizing the above-mentioned detection device.

2. Description of the Prior Art

It is a well-known fact that railroad models have been equipped with crossing gate mechanisms constructed so that when a train passes over a predetermined fixed position on the tracks the crossing gate and the warning signal device are activated, whereupon the gate arms are lowered to block the crossing. After the train has passed through the crossing, the gate arms are raised and the crossing gate and warning signal device are then deactivated. In addition to this basic structure, there exist train sets equipped with three-color warning signal devices which are activated and switched depending on the position of the train on the tracks.

In general, the gate crossing mechanism and the warning signal devices of these kind of railroad models are activated and deactivated by detectors provided on both sides of the crossing at the extremities of a predetermined length of track which defines an activation region for the crossing. In other words, when a train enters into this activation region, its presence is detected by one of the detectors, which then activates both the gate crossing mechanism to close the crossing and the warning signal device to emit a warning signal. Then when the train passes out of the activation region, this is detected by the other detector, which then deactivates the gate crossing mechanism to open up the crossing and shuts off the warning signal device.

At such times, it is extremely important that the train detection device be precise in detecting the presence of the train at close proximity to the crossing and in detecting the passage of the train through the crossing. To accomplish this task it is possible to use two types of detectors, namely, a contact type detector which makes physical contact with the train and a non-contact type detector which does not make physical contact with the train.

As the contact type detector, there is known a microswitch that is provided in a space between the rails of the tracks so as to make contact with the wheels of the train when the train rides over the microswitch, thereby changing the ON/OFF mode of the microswitch.

As for the non-contact type detectors, several arrangements are in general use, such as the provision of a silicon diode in series circuit between the rail and the power supply feeder, which utilizes drops in voltage, or a light sensor comprising an opposing pair of a light-emitting diode placed on one side of the tracks and a light-receiving diode placed on the other side of the tracks. There is also a reflected light type sensor that comprises a light emitting diode provided in the space between the rails to emit light upwardly away from the tracks, a reflector provided on the bottom of the train for reflecting such light, and a light-receiving diode for detecting the reflected light from the reflector.

However, with regards to the contact type detector mentioned above, with each pass of the train, the microswitch gets flicked back and forth between its ON/OFF mode, and this leads to damage of the switch over time. Furthermore, dust and other particles are likely to be accumulated at the contact point of such switch, resulting in poor, and eventually insufficient, contact between the train and such switch. Moreover, there is the added adverse influence upon the control of the operation of the train as a result of the increased resistance arising from the unavoidable mechanical contact of the switch with the wheels of the train.

Now, as for the non-contact type detectors, in the case of the voltage-drop detectors, any change in speed of the train can easily give an adverse effect on the function of the detector. In other words, if the speed of the train is not constant, the detector will be unable to detect the train's approach or passage.

In the case of the light sensor comprising an opposing pair of light-emitting and light-receiving sensors, the presence of these two elements on or in the vicinity of the tracks has a degrading affect on the appearance of the railroad model. Moreover, when the train has a plurality of cars, the spacing between adjacent cars allows the light emitted from the light-emitting diode to reach the light-receiving diode, which results in the sensor being switched back and forth between the ON and OFF modes a multiplicity of times as the train passes by the sensor, making it a very cumbersome method of detecting the passage of the entire train.

With regards to the reflection type sensor, if the reflector gets dirty or scratched, the light reflected therefrom will be irregular, which can give rise to malfunctions. Moreover, the sensor will respond to such things as a cat jumping over the tracks where the sensor is located or a person peering into the the sensor, resulting again in malfunction of the sensor.

In order to remedy the above-mentioned problems, it becomes necessary to implement complex controls that give rise to increased costs, thereby making the railroad model that incorporates such complex controls prohibitively expensive.

Further, even though most railroad models are constructed to allow an operator to change the direction of the electric current supplied to the rails in order to change the direction of motion of the train, in the prior art railroad models mentioned above, various unfavorable outcomes can arise when the direction of motion of the train is changed while the train is still within the crossing gate activation region. For example, if the direction of motion of the train is switched after the train has entered into the activation region but before the train has yet reached the crossing, the crossing gate will still remain closed. Moreover, if the direction of motion of the train is changed just before the train has reached the sensor on the other side of the crossing, the train will pass back through an open crossing.

SUMMARY OF THE INVENTION

The main object of the present invention is to solve those problems discussed above. More specifically stated, it is a part of the main object of the present invention to provide, for use in railroad models, a non-contact type train detection device that does not affect the speed of a train when the train is being detected by the train detecting device. Still another part of the main object of the present invention is to provide such a train detection device that eliminates the occurrence of malfunctions involving operations of the crossing gate mechanism and warning signal device. Yet another part of the main object of the present invention is to provide such a train detection device that has a pleasant appearance when installed in railroad models. Still yet another part of the main object of the present invention is to provide such a train detection device that can easily be manufactured at low cost.

It is another object of the present invention to provide a train crossing control apparatus that automatically operates the crossing gate device and warning signal device of a railroad model when installed with the train detection device according to the present invention.

It is yet another object of the present invention to provide a train crossing control apparatus that eliminates the problem of the crossing gate remaining open or closed at the wrong times when the direction of motion of the train is reversed after the train has entered the train crossing activation region.

In order to achieve the objects stated above, the train detection device of the present invention is provided inside the rails of the tracks of a railroad model so as to detect the close approach or passage of a train. For carrying out such detection, the train detection device of the present invention comprises a capacitance type sensor that detects the approach or passage of the train by responding to the capacitance in the train when the train is running over the tracks where the sensor is located.

By using the capacitance type sensor mentioned above, the train detection device becomes a non-contact type detection device, which avoids the kind of damage that can occur with contact type detectors. Moreover, as there is no direct physical contact between the train detection device and the train being detected, the train detection device of the present invention in no way interferes with the control of the train when the train is operated to move along the tracks. Furthermore, as the train detection device of the present invention does not utilize drops in voltage, the train detection device will not be affected by changes in the speed of the train. Also, the problems encountered with the use of light diode sensors are eliminated, and since the train detection device of the present invention is provided inside the tracks in an unobtrusive way, railroad models installed with the train detection device of the present invention will be able to maintain a pleasant appearance.

The train crossing control apparatus of the present invention is adapted for use in railroad models equipped with a crossing gate device capable of opening and closing a crossing that allows a road to pass across the tracks, a crossing gate driving means that drives the crossing gate device to open and close the crossing, a warning signal device that emits a warning when a train is approaching or passing through the crossing, and a control means for controlling the operations of the crossing gate driving means and the warning signal device. In such railroad models, the train crossing control apparatus comprises capacitance type activation sensors each provided on either side of the crossing at specific locations along the tracks, respectively, so as to define an activation region lying in-between the two sensors, each of the activation sensor detecting the approach or passage of a train over the sensor by the change in capacitance that arises at such times. The train crossing control apparatus further comprises a capacitance type train crossing sensor that detects the approach or passage of a train through the crossing, and a reverse motion detection device that detects reversal of the direction of motion of the train. With these elements the train crossing control apparatus of the present invention is able to determine the position of the train within the activation region, so as to accurately and reliably control the operations of the crossing gate driving means and warning signal device irregardless of any changes in the direction of motion thereof.

The basic operation of the train crossing control apparatus of the present invention can be understood by the following two explanatory cases.

First, in the case where there are no changes in the direction of motion of the train, the train's presence is detected by one of the activation sensors upon entering the activation region, and this calls up a standard operation program that activates the warning signal device to emit a warning signal and outputs a signal to the crossing gate driving means to close the crossing. Then when the train has passed completely out of the crossing, the warning signal device is deactivated to terminate the warning signal and the crossing gate driving means is instructed to open the crossing.

Now, in the case when the direction of motion of the train is reversed after the train has entered the activation region, this reversal of the direction of motion is detected by the reverse motion detection device, whereby a reverse motion program is called up to override the standard program. If the reversal in the direction of motion of the train occurred before the train reached the crossing, the program immediately instructs the warning signal device to terminate the warning signal and the crossing gate driving means to open the crossing. However, if the reversal in the direction of motion occurred while some part of the train was still in the crossing, the reverse motion program waits until the train has passed completely back out of the crossing before instructing the warning signal device to terminate the warning signal and the crossing gate driving means to open the crossing. If, on the other hand, the reversal in the direction of motion of the train occurred after the train had passed the crossing completely, the reverse motion program first instructs the warning signal device to emit a warning signal and the crossing gate driving means to close the crossing, and upon determining that the train has passed completely back through the crossing, the program then instructs the warning signal device to terminate the warning and the crossing gate driving means to open the crossing.

From the above description, it is easy to see that the train crossing control apparatus of the present invention assures proper and reliable operation of the warning signal device and crossing gate driving means under all conditions encountered in the operation of railroad models. In other words, the train crossing control apparatus of the present invention enables railroad models to be operated in ways not possible with prior art control systems, namely, in ways that mimic the real life operations of actual railroads. Moreover, the train crossing control apparatus of the present invention achieves these results in a new and novel way over the prior art.

DETAILED DESCRIPTION OF FILE PREFERRED EMBODIMENTS

Figure 1:
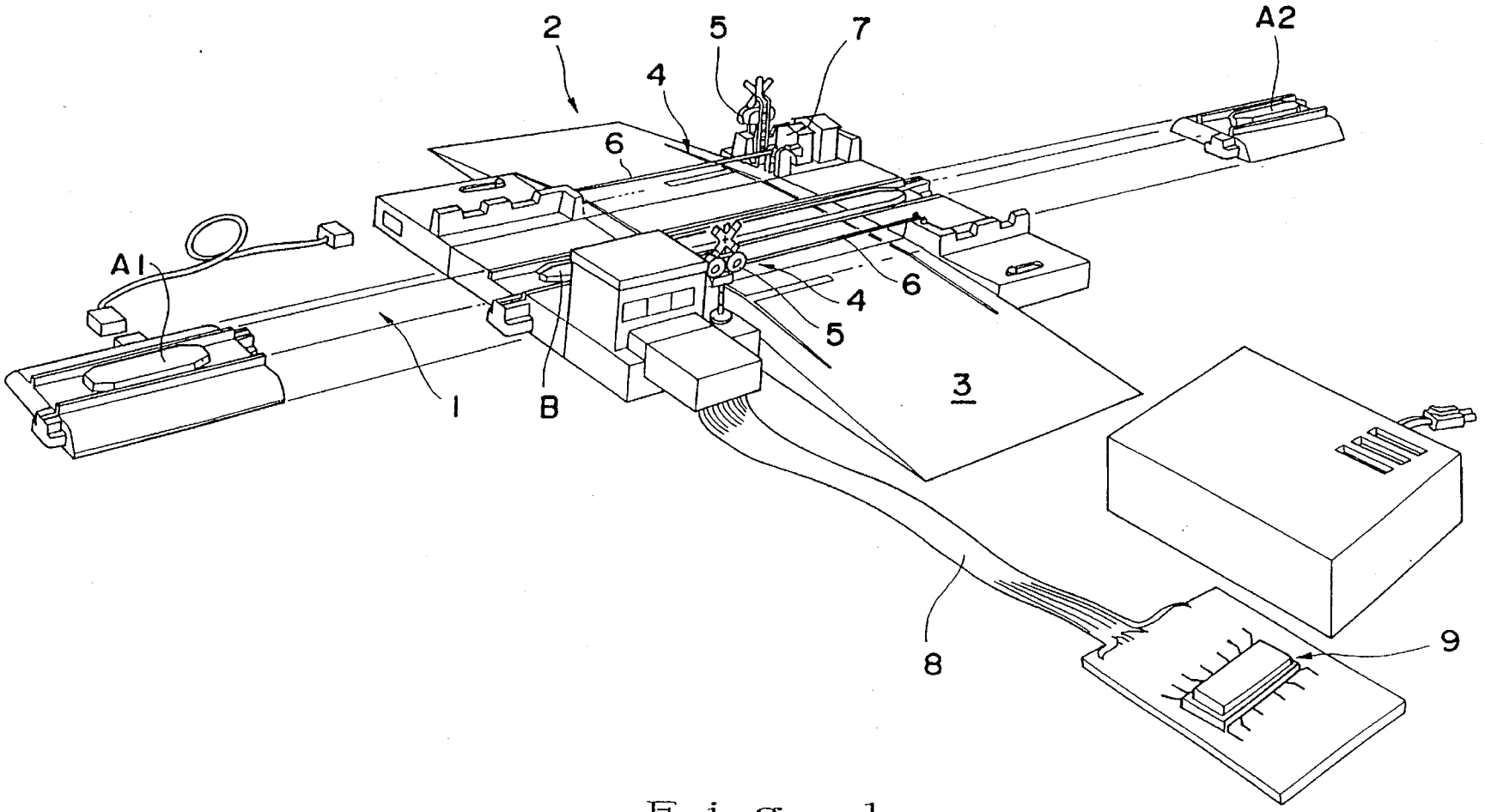
FIG. 1 is a perspective view of a portion of a model railroad layout including a crossing incorporating the train detection device of the present invention.
Figure 2:
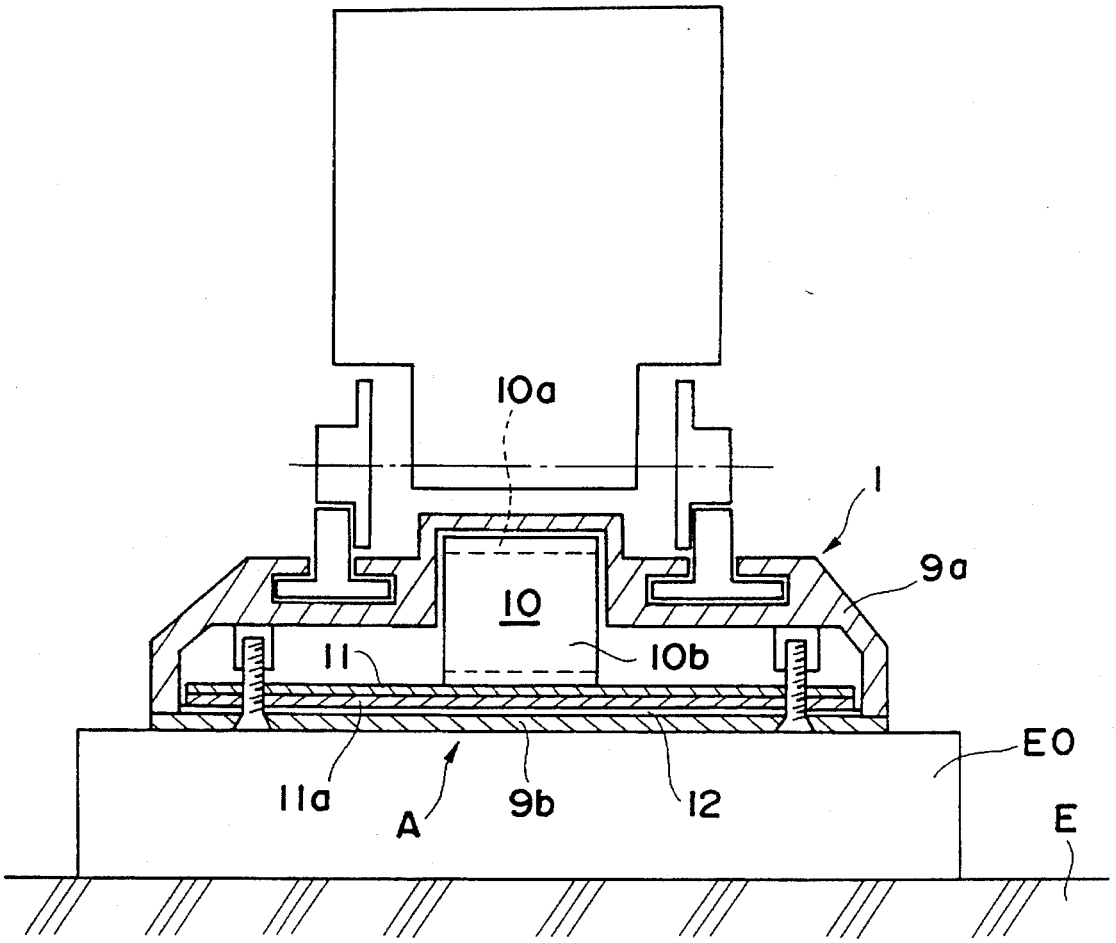
FIG. 2 is a cross-sectional view illustrating a state in which a train is riding above a train detecting device according to the present invention.

Described herein below is a detailed description of the preferred embodiments made with reference to the drawings. FIG. 1 shows a perspective view of a railroad crossing suited for use with the present invention. FIG. 2 is a cross-sectional view showing the state of a train riding over one of the train detection devices of the present invention, and FIG. 3 illustrates front and top views of an electrode used in the first embodiment of a train detection device according to the present invention.

As shown in FIG. 1, provided at an appropriate location on railroad model tracks 1 is a railroad crossing 2. The crossing 2 comprises a road 3 that allows the passage of pedestrians and vehicles across the tracks 1, a crossing gate 4 provided on both sides of the tracks 1 to form an opposing pair of crossing gates 4, 4 in order to open and close the road 3, and a warning signal device 5 provided next to each crossing gate 4 to form a pair of warning signal devices 5, 5 that act in cooperation with the crossing gates 4, 4. In this embodiment the warning signal devices 5, 5 comprise a pair of red lights that alternately flash on and off and a means for generating a warning sound. Each crossing gate 6 comprises a gate arm 6 that can be rotated between a vertical position that opens up the crossing and a horizontal position that closes the crossing, the gate arm 6 being supported at the base end thereof by a crossing gate driving means 7.

The warning signal device 5 and the crossing gate driving means 7 are connected via a flat cord 8 to a CPU 9 which acts as a control means by sending control signals to operate the warning signal 5 and the crossing gate driving means 7. Namely, when the crossing is to be closed, the CPU 9 outputs a signal that activates the warning signal device 5 to begin emitting a warning signal while at the same time outputting a closing signal to the crossing gate driving means 7, which then lowers the gate arms 6 to close the crossing. The when the crossing is to be opened, the CPU 9 outputs a deactivation signal to the warning signal device 5 and an opening signal to the crossing gate drive means 7 to raise the gate arms 6 to open the crossing.

Now, located along the tracks 1 on either side of the crossing 2 are sensors A1, A2 for detecting the approach or passage of a train to or over such sensors. Further, there is an additional sensor B provided underneath the crossing 2 to detect the approach or passage of a train to or over the crossing. Based on the output from these detectors, signals are then sent via controller (CPU) 9 to control the operations of the warning signal device 5 and the crossing gate driving means 7. For example, when either of the sensors A1, A2 detects a train, the warning signal device 5 and the crossing gate driving means 7 are operated, and when the train detecting sensor B detects that the train has passed over the crossing completely, the operation of the warning signal device 5 and the crossing gate driving means 7 are terminated.

As shown in detail in FIG. 2, the tracks 1 comprise an upper casing **9*a* and a lower casing 9*b*, and the sensors A1, A2 and B are provided in the spacing between the upper and lower casings 9*a*, 9*b*. These sensors have a detection electrode 10 and a reference electrode 13 provided in the space between the rails along the lengthwise direction thereof, and a circuit substrate 11 provided under the electrodes 10, 13 and electrically connected thereto, the circuit substrate 11** being equipped with an electric circuit that detects changes in the capacitance of these electrodes and outputs such changes.

Figure 3A:
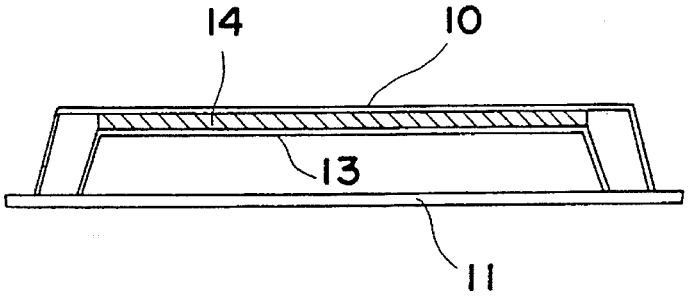
FIG. 3A illustrates a front view of the construction of the electrodes according to one embodiment of the present invention.
Figure 3B:
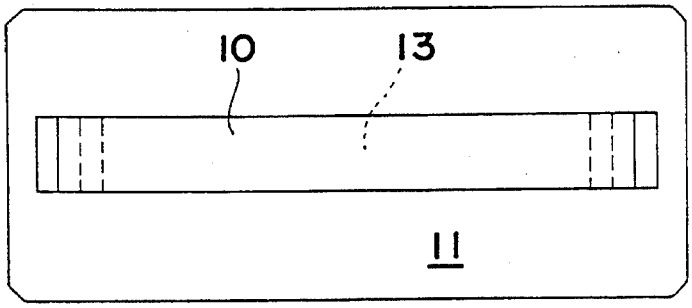
FIG. 3B illustrates a top view of the construction of the electrodes according to one embodiment of the present invention.

As shown in FIG. 3A, each of the detection electrode 10 and reference electrode 13 are formed from an appropriate length of long, thin metal sheets. The reference electrode 13 is formed so as to be shorter than the detection electrode 10, and is positioned below the detection electrode 10, with an insulating material 14 provided therebetween to prevent the electrodes 10, 13 from coming into contact with each other. Also, both sides of each of the electrodes 10, 13 are bent downwardly, and these bent portions are connected to the electric circuit provided in the circuit substrate 11. Moreover, the detection electrode 10 is accommodated inside a convex portion of the upper easing **9*a* so as to form an opposing surface spaced a suitable distance from a train passing over the sensor. For this reason, from the outside the detection electrode 10** is not noticeable to an observer, and therefore does not have a degrading affect upon the appearance of the railroad model.

Figure 4:
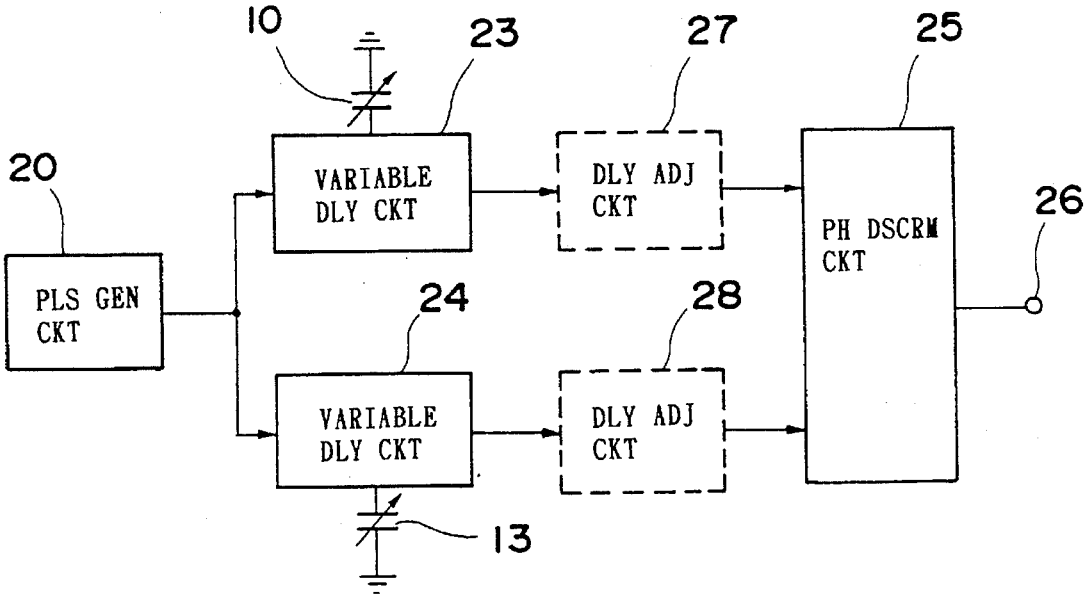
FIG. 4 illustrates an electric circuit of the present invention.

As shown in the block diagram of FIG. 4, the electric circuit comprises a pulse generating circuit 20, first and second variable delay circuits 23, 24 connected respectively to the detection electrode 10 and reference electrode 13, each variable delay circuit being adapted to delay a pulse from the pulse generating circuit 20 by a time lag dependent solely on the capacitance value of its respective electrode, and a phase discriminating circuit 25 for discriminating a phase difference between the pulses outputted from the respective variable delay circuits 23, 24 and then outputting this information to an output terminal 26 that outputs the measured information. As the amount of delay generated by each of the delay circuits 23, 24 is directly determined by the capacitance value of the respective electrode, it becomes possible to detect relative differences in the capacitance of each electrode by the use of the phase discriminating circuit 25 to detecting any phase difference between the pulses outputted by the variable delay circuits 23, 24. Namely, when a train has reached or is passing over the sensor, the capacitance of the detection electrode 10 changes relative to that of the reference electrode 13 on account of the capacitance of the detection electrode 10 being affected by the capacitance of the train due to the close proximity of the detection electrode 10 relative to the train. This results in a phase difference (time lag) being detected for the pulses outputted from the variable delay circuits 23, 24 connected to the electrodes 10, 13, and this phase difference enables the sensor to determine the approach or passage of the train over the sensor.

By providing the sensor with the two electrodes 10, 13 described above, environmental influences, such as changes in temperatures and the like, have an equal effect upon each electrode and therefore they are mutually cancelled each other. In particular, when the direct current flowing through the rails has an affect upon the capacitance values of the electrodes 10, 13, the resulting change in capacitance is the same for each of the electrodes 10, 13 and therefore mutually cancel each other out. Namely, the delay of the pulses outputted from the variable delay circuits 23, 24 are the same, and therefore no phase difference is detected in the phase discrimination circuit 25. Thus, the accuracy of the sensor is not affected by changes in the surrounding environment.

As for the variable delay circuits 23, 24, they may be constructed by replacing the capacitor in a known delay circuit, such as an R-C integrating circuit, an L-C integrating circuit or a low-pass filter, with the respective electrodes (transducers) 10, 13 of the present invention, and then combining each of these modified delay circuits with a conventionally known binary circuit, such as a Schmidt circuit. With regards to the phase discriminating circuit 25, it is possible to employ any means that can detect a phase difference for each set of pulses received from the delay circuits 23, 24. Moreover, the phase discriminating circuit 25 may output information in either analog or digital format.

Delay adjusting circuits 27, 28 are optional circuits that can be provided in the sensor for adjusting the off-set of pulses received, respectively, from the variable delay circuits 23, 24, and may be constructed, for example, by a one-shot multivibrator or the like. As shown in the example illustrated in FIG. 4, the delay adjusting circuits 27, 28 are provided corresponding to their respectively variable delay circuits 23, 24. However, it is possible to eliminate either of the delay adjusting circuits 27, 28, or to carry out adjustment of the off-set at locations other than the delay adjusting circuits 27, 28, for example, at the variable delay circuits 23, 24.

Next, the precise construction of each circuit will be explained with reference to the embodiment shown in the drawings. Namely, the pulse generating circuit 20 is constructed with a schmidt circuit, a condenser and a resistor for generating pulses in the form of a rectangular wave; each of the variable delay circuits 23, 24 is constructed with a schmidt circuit and an integrating circuit made up of a resistor and a transducer (either the detection electrode 10 or the reference electrode 13); and the phase discrimination circuit 25 is constructed with an edge-clocked D-type flip-flop.

Figure 5:
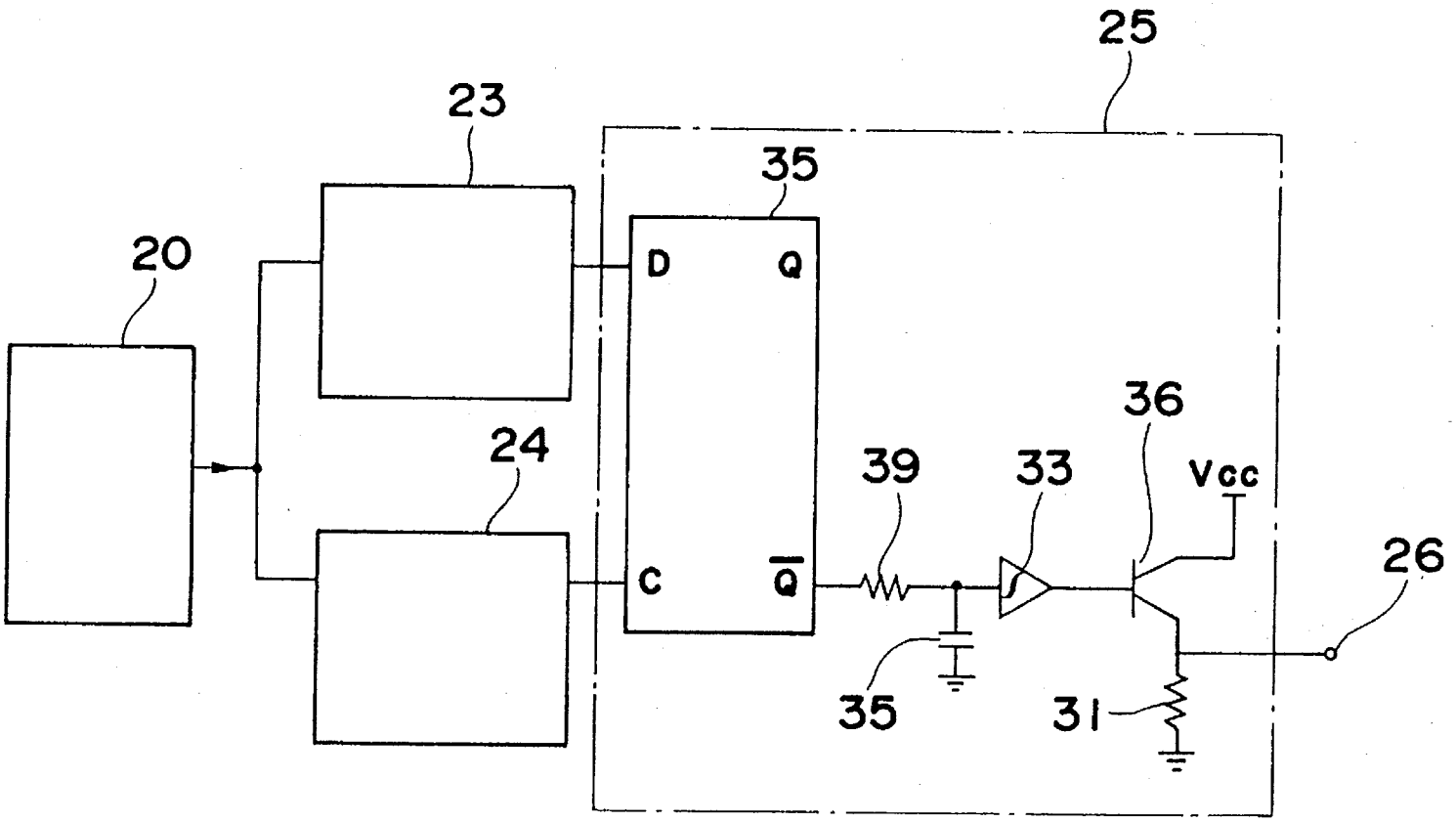
FIG. 5 illustrates an inner circuit portion of a phase discrimination circuit according to the present invention.

In FIG. 5, the construction of the phase discrimination circuit 25 is shown in detail. In this diagram, the Letters C, D, Q and $\overline{Q}$ of the edge-clocked D-type flip-flop 35 designate, respectively, a clock input terminal, a data input Q terminal, an output terminal and an inverted output terminal. Furthermore, numerals 31, 39 designate resistors, while numerals 35, 36 and 33 designate, respectively, a condenser, a transistor and a schmidt circuit. The D-type flip-flop of FIG. 5 converts data delivered to the data input terminal D in accordance with the timing of the rise of each pulse fed to the clock input terminal C and then outputs the converted output from the Q terminal and its inverted output from the $\overline{Q}$ terminal. Table 1 below is a truth table of the D-type flip-flop 35.

TABLE 1

| clock input | data input | Q output | $\overline{Q}$ output |
|---|---|---|---|
| leading | 0 | 0 | 1 |
| leading | 1 | 1 | 0 |
| trailing | X | Q | $\overline{Q}$ |

The $\overline{Q}$ terminal of the D-type flip-flop 35 is connected to the base of the transistor 36 through the resistor 39, a low-pass filter comprising the condenser 35, and the schmidt circuit 33, with the output terminal 26 being connected to the emitter terminal of the transistor 36. Accordingly, when the $\overline{Q}$ terminal is "1", the output will be "1", and when the terminal is "0", the output will be "0".

Figure 6:
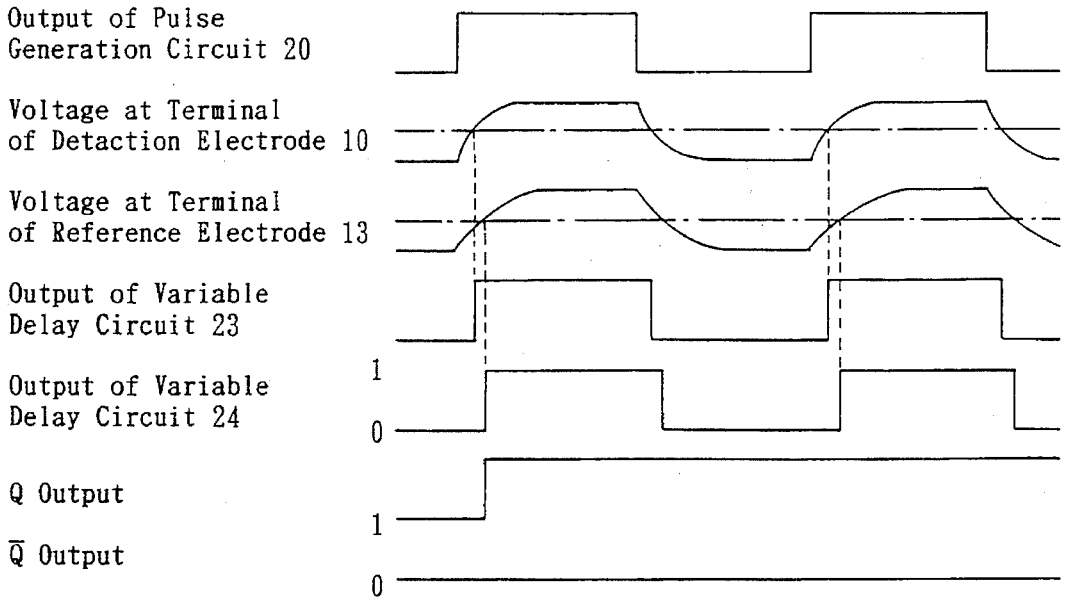
FIG. 6 illustrates one example of the waveform of a signal at the output terminal of each component of the circuit depicted in FIG. 5 when the circuit is actuated.
Figure 7:
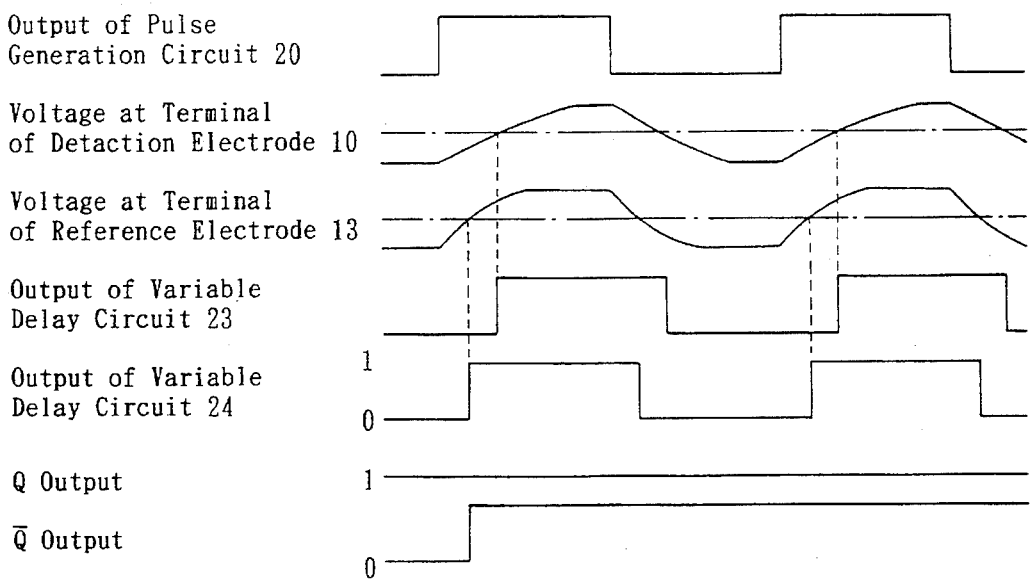
FIG. 7 illustrates another example of the waveform of a signal at the output terminal of each component of the circuit depicted in FIG. 5 when the circuit is actuated.

FIGS. 6 and 7 illustrate examples of the waveform of a signal at the output terminal of each component of the circuit depicted in FIG. 5 when the circuit is actuated. First, the sensor is adjusted to make its output "0" when not detecting the presence of a train. Stated more concretely, as shown in FIG. 6, this adjustment is done by delaying the phase of the pulse fed to the clock input terminal C of the D-type flip-flop 35 relative to the phase of the pulse fed to the data input terminal D.

In this state, the output of the terminal $\overline{Q}$ is "0", and the output of the terminal Q is "1". Now, while the sensor is in this type of state, if a train passes over the detection electrode 10, the capacitance of the transducer comprising the detection electrode 10 becomes large by the capacitance in the train, whereby the charging characteristics of the transducer become small, as is shown in FIG. 7. And, as is also shown in FIG. 7, this reverses the phase difference between the pulse fed to the clock input terminal C and the pulse fed to the data input terminal D of the D-type flip-flop 35. As a result, the output of the $\overline{Q}$ terminal becomes "1", and the transistor 36 is switched to the "ON" mode, thereby detecting the presence of the train above the sensor.

Now, when the train detection apparatus of the present invention is incorporated in a railroad model, the entire surfaces of the electrodes which are positioned within the tracks so as to extend along the rails detect the presence of the train. Therefore, factors such as gaps between train cars and changes in the distance between the electrodes and the bottom surface of the train do not affect the stability of the detection outputs, so that the possibility of the sensor malfunctioning is virtually eliminated. Also, in such instances as the occurrence of chattering caused by external factors, for example, by the passage of a train car linkage over the sensor, the schmidt circuit 33 and the low-pass filter comprising the resistor 39 and the condenser 35 respond in a way that prevents such chattering before it arises, thereby making it possible to obtain a stable output.

As shown in FIG. 2, the underside surface of the circuit substrate 11 is formed as an insulating body 11a. Provided under the entire bottom surface of the circuit substrate 11 is a metal plate 12, with the underside surface of the metal plate 12 being in contact with the bottom case 9b which forms a bottom covering. Accordingly, as shown in FIG. 2, the following elements are arranged in order from top to bottom: the circuit substrate 11, the insulating body 11*a*, the metal plate 12, and the lower casing 9*b*, with this entire arrangement of the tracks 1 being supported by a supporting portion E0 (for example, the surface of a floor) and the supporting portion E0 in turn being connected to a ground E.

The arrangement of these elements provides two condensers connected in series between the circuit substrate 11 and the metal plate 12 and between the metal plate 12 and the supporting portion E0 from the viewpoint of their capacitance. With such arrangement, it is possible to alleviate changes in the ON, OFF threshold values in the circuit due to minute variances in the difference in electric potential between the supporting portion E0 and the ground E. Accordingly, irregardless of the kind of material forming the supporting portion E0, it is possible to suppress detection aberrations of the capacitance sensor A. In this regard, if the metal plate 12 is electrically connected to the ground, it is possible to further reduce an adverse affect which may be suffered from change of the material for the supporting portion E0 positioned under the track 1.

In the construction described above, by setting the train detection distance at a predetermined length by changing the resistance of the variable resistor in the circuit, the sensor will not be switched to the ON mode by the approach or presence of other objects, people or animals such cats and dogs. On the other hand, however, when a train approaches the sensor, the oscillation frequency changes due to the capacitance of the train, whereby the control portion of the IC outputs to the OUT terminal a signal indicating that a train has been detected. Further, when the detection electrode 10 and circuit substrate 11 are provided inside the tracks of a railroad model in a manner similar to this preferred embodiment described above, no part of the train detection device is exposed, thereby making it possible to maintain the pleasant appearance of the railroad model.

Figure 8A:
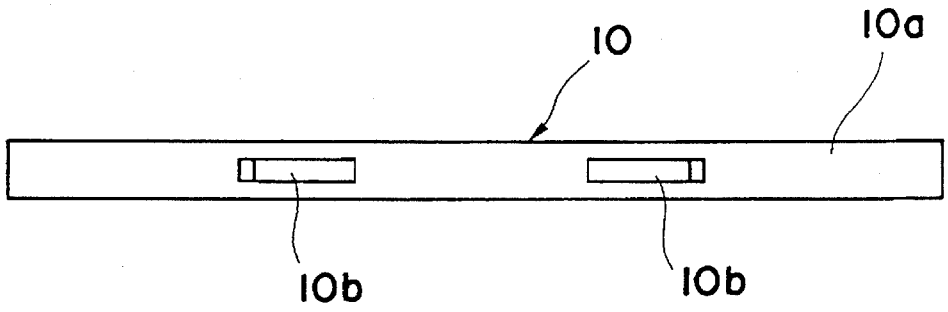
FIG. 8A illustrates a top view of the construction of an electrode according to another embodiment of the present invention.
Figure 8B:
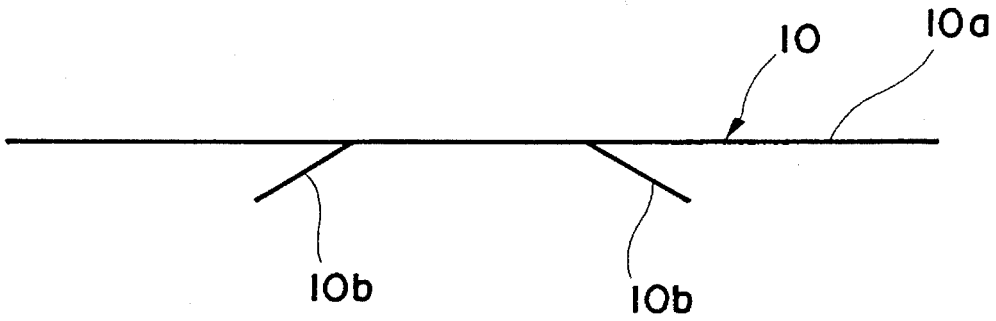
FIG. 8B illustrates a front view of the construction of an electrode according to another embodiment of the present invention.

FIG. 8 shows top and front views of the construction of a detection electrode in another embodiment of the present invention. In this embodiment, the detection electrode 10 is formed by bending down leg portions 10*b*, 10*b* that have been cut out from a flat sheet 10*b*. In this construction the bent leg portions 10*b* make elastic contact with the circuit substrate, thereby making it possible to obtain satisfactory electrical contact therebetween. In this regard, it should be noted that the construction of the detection electrode is no limited to the above construction. It is also possible to adopt other structure in which the opposite longitudinal ends of the flat sheet 10*a* are bent downwardly roughly at an angle of 90 agree to form the leg portions 10*b*, 10*b* and thus formed leg portions 10*b*, 10*b* are electrically connected to the circuit board 11. Further, the leg portions 10*b*, 10*b* can be formed so as to extend downwardly from the side edges of the opposite longitudinal portions of the flat sheet 10*a*, which enables to make the area of the defection electrode as much as possible.

In this embodiment the reference electrode has been omitted, and only the detection electrode is provided. Namely, the capacitance sensor of this embodiment comprises a detection electrode provided along the tracks, a pulse generating circuit for generating a predetermined pulse, first and second delay circuits, and a phase discriminating circuit for discriminating the difference in phase of corresponding signals outputted from the delay circuits and outputting such measured phase difference to an output terminal as a measured data. Furthermore, in this construction the first delay circuit is connected to the detection electrode and is adapted to delay a pulse received from the pulse generating circuit by a quantity corresponding to the capacitance value of the detection electrode, and to output the thus-delayed pulse.

As it is possible to predetermine the affects of such factors as the flow of current supplied to the rails of the tracks upon the capacitance values of the electrodes, the reference electrode is omitted when this embodiment is incorporated in a railroad model. In this case, the second delay circuit that would have been connected to the reference electrode is instead provided with a means for making the pulse signal that is outputted from the second delay circuit have the same phase as the pulse signal outputted from the variable delay circuit of the first delay circuit when the detection electrode is in a non-detection state. Specifically, the resistance value of the resistor in the second delay circuit is set so that the delay time constant of the second delay circuit is larger than the delay time constant of the first delay circuit. As an alternative, it is also possible to connect a condenser having a capacitance corresponding to that of the reference electrode to the second delay circuit.

In this way, by omitting the reference electrode and using only the detection electrode, it is possible to simplify the construction of the capacitance-type detector. Moreover, such simplification allows the train detection device to be manufactured at lower cost.

While the descriptions given above were related to the control of the opening and closing of a train crossing section of a railroad model, it is possible to utilize the present invention for the control of other elements of railroad models. For example, the detection device of the present invention can be used for determining the position of the train in order to control the ON and OFF switching of lighting or the switching between different modes of lighting, and can be used to control the OPEN and CLOSE operations of a train garage when a train is to be housed therein.

Moreover, the present invention is not limited to use in railroad models, and can be used, for example, in racing car kits by incorporating the sensor in a detection apparatus located at the goal to determine the order of arrival of the racing cars.

Figure 9:
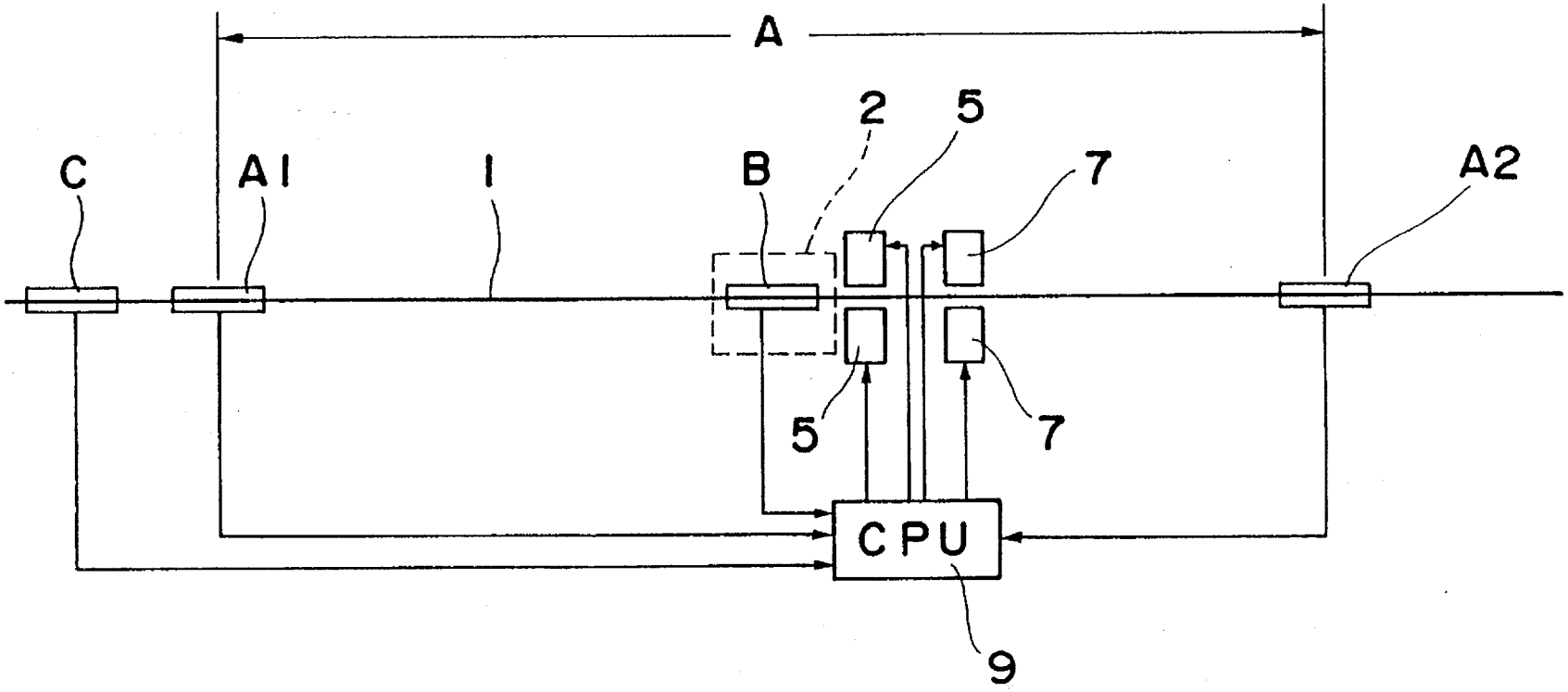
FIG. 9 is a schematic diagram illustrating the arrangement of each detection device of the train crossing control apparatus according to the present invention.

With reference to the drawings a preferred embodiment of a crossing gate control apparatus incorporating the above-described train detection device according to the present invention will now be described in detail below. FIG. 9 is an illustration showing the arrangement of each sensor of FIG. 1, and FIGS. 10 through 12 are flow charts showing the control programs of the present invention.

As shown in FIG. 9, activation sensors A1, A2 are provided along the tracks on either side of the train crossing to define an activation region A, and provided at the crossing is a crossing sensor B for detecting the presence or passage of a train through the crossing on the basis of the capacitance in the train. These sensors A1, A2, B are constructed. Now, when a train enters into this region, a warning signal device and the crossing gate driving means 7 are activated by specific controls. In other words, when the train approaches either of the edges of the activation region A, its presence is detected by the sensor defining that edge. As for the distance between each of the activation sensor A1, A2 and the crossing sensor B, it need not be the same as the entire length of the train, but instead only needs to be longer than the length of the shortest train car length. The normal mode of the sensors A1, A2 and B are set to be in the OFF mode, with each sensor being switched to the ON mode upon detection of the presence of an approaching train, and are switched back to the OFF mode after the presence of the train is no longer detected. In other words, when the train passes over a sensor, its mode is switched from OFF to ON back to OFF. Moreover, the ON-OFF operation of these sensors can be carried out in reverse.

Furthermore, the present invention is equipped with a reverse motion detection device C which detects changes in the direction of motion of the train. The reverse motion detection device C is constructed so as to monitor the polarity of the rails, whereby it is able to detect when the direction of motion of the train has been changed by detecting the change in direction of the current supplied to the rails.

In the present invention the CPU executes control programs when the train enters the crossing gate activation region A lying between the activation sensors A1 and A2. When either sensor A1 or A2 is switched from its OFF mode to its ON mode, the control programs are implemented and the CPU 9 outputs an activation signal to the warning signal device 5 and an activation signal (i.e., crossing closing signal) to the crossing gate driving means 7. The warning signal device 5 then emits a warning signal while the crossing gate driving means 7 lowers the gate arms to close the crossing. After the train has passed and the activation sensor A1 or A2 that was initially switched to ON is switched back to OFF, and after the crossing sensor B has been switched from OFF to 0N back to OFF again, the activation signal output to the warning signal device 5 is terminated, thus cancelling the warning signal. At the same time, the crossing gate driving means is instructed to raise the gate arms 6 to open the crossing.

Now, in the situation where the train has entered the activation region A and activation signals are being outputted to the warning signal device 5 and the crossing gate driving means 7, if the direction of current supplied to the rails is reversed, then the reverse motion detection device C is switched to the ON mode. At this time if the crossing sensor B is in the OFF mode (i.e., the train stopped before reaching the crossing sensor B and started moving in the opposite direction), or when the crossing sensor B is switched back to its OFF mode as the train moves in the opposite direction, the activation signal to the warning signal device 5 will be terminated and an OPEN signal will be outputted to the crossing gate driving means 7 to open the crossing. On the other hand, there is the situation where the direction of motion of train is reversed after the train has passed the crossing but before the train has not yet exited the activation region. At this moment, even though the crossing sensor B had been switched to the OFF mode resulting in the warning signal device being deactivated and the warning signal device 5 being opened, the reverse motion detection device C gets switched to the ON mode and a CLOSE signal is outputted to the crossing gate driving means 7 to close the crossing and an activation signal is outputted to the warning signal device 5 to emit a warning signal. Then when the crossing sensor B gels switched from the OFF mode to the ON mode back to the OFF mode, the activation signal to the warning signal device 5 is terminated and an OPEN signal is outputted to the gate crossing driving means 7 to open the crossing.

Next, with reference to the flow charts, the operation programs of the CPU will be described. These programs comprise a standard operation program (Program I) that controls operations when the train is traveling on the tracks in one direction, and a reverse motion operation program (Program II) that is called up to interrupt the standard operation program when the direction of motion of the train is reversed (namely, when the reverse motion detection device C is switched to the ON mode).

Figure 10:
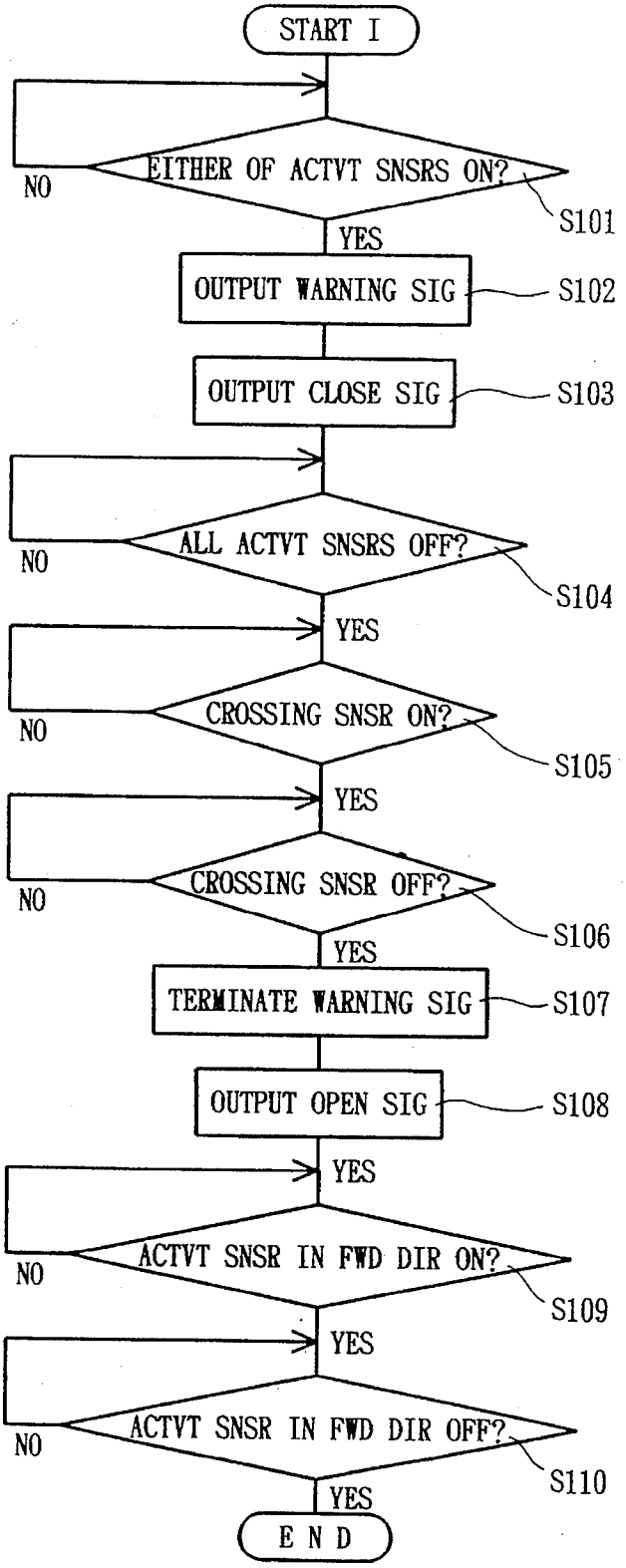
FIG. 10 illustrates a flow chart of a control program (Standard Operation Program) of the present invention.

The flow chart shown in FIG. 10 illustrates Program I. This flow chart will be used as a reference in explaining the basic operation of the present invention when the train is traveling in one direction of motion along the tracks. In this first example, the direction of motion will be assumed to be constant from left to right with respect to the illustrations and drawings. When program I is started, the moment power is supplied to the railroad model, and until one of the activation detectors A1, A2 detects the presence of a train, the program remains on standby (i.e., Step S101).

Now, when a train coming along the tracks from the left side of the drawings reaches the activation sensor A1, this sensor A1 detects the presence of the approaching train and gets switched from its OFF mode to its ON mode, and the CPU outputs an activation signal to the warning signal device 5 and a CLOSE signal to the crossing gate driving means 7 (Steps S101–S103). The warning signal device 5 then emits a warning signal, for example, a signal having an envelope of 900 HZ, and the crossing gate driving means 7 then lowers the gate arms 6 to close the crossing.

Next, the program determines whether or not the train has passed completely over the sensor A1 (Step S104). In this instance, as soon as the very end portion (i.e., the tail portion) of the train passes over the sensor A1, the sensor A1 is switched from the ON mode to the OFF mode, which enables the program to determine that the train has passed completely over the sensor A1. Furthermore, as the train begins to enter the crossing 2, its presence is detected by the crossing sensor B, which is then immediately switched from the OFF mode to the ON mode. Then as the train passes over and out of the crossing 2, the crossing sensor B is switched from the ON mode back to the OFF mode, after which a deactivation signal is outputted to the warning signal device 5 and an OPEN signal is outputted to the crossing gate driving means 7 (Steps S105–S108). This results in the crossing gate driving means 7 raising the gate arms 6 to open the crossing and the warning signal device 5 being deactivated to terminate the warning signal.

Next, the program determines whether or not the train is still within the crossing gate activation region A, namely, whether or not sensor A2, which lies in the forward direction of motion of the train, has been switched to the 0N mode (Step S109). In this regard, before the sensor is switched to the ON mode, the train still remains within the crossing gate activation region. Then when the sensor A2 gets switched to the ON mode, namely, when the train reaches the sensor A2, the program determines whether or not the sensor has been switched back to the OFF mode (Step S110). In other words, the program determines whether or not the train has passed completely over the sensor A2. In this case, the switching of the sensor A2 from the ON mode to the OFF mode means that the train has passed completely over the sensor A2.

At this point the program is terminated. However, the program described above is repeated each time a train is detected by either of the sensors A1, A2 upon entering the crossing gate activation region A.

Discussed next will be the situation in which the direction of motion of the train is reversed after a portion of the train has entered into the crossing gate activation region A. In this instance there are three patterns that can arise: Pattern 1, in which the direction of motion of the train is reversed before the crossing sensor B is switched to the ON mode (i.e., before the train passes into the crossing); Pattern 2, in which the direction of motion of the train is reversed while the crossing sensor B is still in the ON mode (i.e., while some portion of the train is still within the crossing); and Pattern 3, in which the direction of motion of the train is reversed after the crossing sensor B has been switched from the ON mode to the OFF mode (i.e., after the train has passed completely through the crossing).

Figure 11:
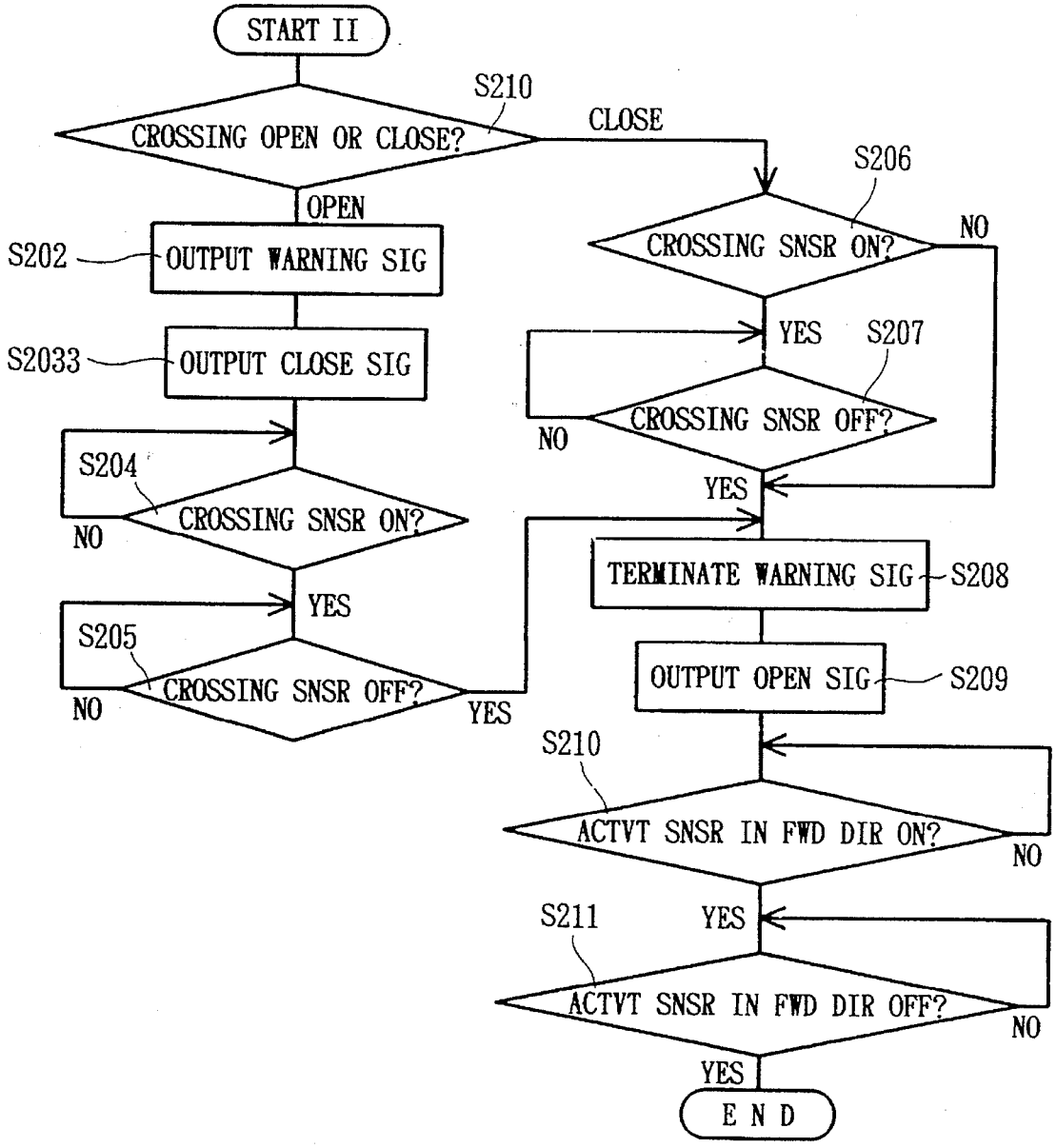
FIG. 11 illustrates another flow chart of a control program (reverse Motion Operation Program) of the present invention.

Now, when the direction of motion of the train is reversed according to one of the above-mentioned patterns during the performance of Program I described previously above, the reverse motion detection device C is switched to the ON mode, and this in turn calls up Program II which interrupts Program I. FIG. 11 illustrates a flow chart for Program II, and this will be used as reference in the description given below.

As it is an absolute precondition that the train be within the crossing gate activation region A, the first step of the program illustrated in the flow chart of FIG. 11 is the step of determining whether or not the train crossing is open (Step S201). In actuality, this is done by determining whether the warning activation signal to the warning signal device is ON or OFF and whether the train crossing OPEN signal (or the train crossing CLOSE signal) is ON or OFF.

In the case where the train crossing is closed, namely, in the case involving either Pattern 1 or Pattern 2 described above, the program then determines whether or not the crossing sensor B is in the ON mode, namely, whether or not some portion of the train still lies within the train crossing (Step S206). If the crossing sensor B is determined to be in the ON mode, that is, Pattern 2 described above, the program determines whether or not the crossing sensor B has been switched back to the OFF mode as the train moves in the reverse direction of motion (Step S207). Immediately upon the program determining that the crossing sensor B has been switched to the OFF mode, i.e., that the train moving in the reverse direction has passed completely out of the train crossing, the warning activation signal to the warning signal device 5 is terminated and a train crossing OPEN signal is outputted to the crossing gate driving means 7 (Steps S208, S209).

Next, the program determines whether or not the train is still within the train crossing actlvation region A, i.e., whether or not the sensor A1, which now lies in the forward direction of motion of the train, is in the ON mode (Step S210). While the sensor A1 is in the OFF mode it means that the train is still within the train crossing activation region A. When the sensor A1 is switched to the ON mode, i.e., when the train reaches the sensor A1, the program then determines whether or not the sensor A1 has been switched back to the OFF mode, i.e., whether or not the train has passed completely over the sensor A1 (Step S211). When the sensor A1 is switched from the ON mode to the OFF mode, it means that the train has passed completely over the sensor A1 and exited out of the train crossing activation region A, whereupon the program is terminated.

However, if at Step S206 the sensor B is determined to not have been switched to the ON mode (i.e., it is still in the OFF mode), that is, the reversal of the direction of motion of the train was begun before the train entered the crossing (Pattern 1 described above), then Step S207 is skipped and immediately thereafter the warning activation signal to the warning signal device 5 is terminated and a train crossing OPEN signal is outputted to the crossing gate driving means 7 (Steps S208, S209). The sequence of steps after this point is then the same as that explained above for the case of Pattern 2.

Now, if at Step S201 the train crossing is determined to be open, i.e., the reversal of the direction of motion of the train is begun after the train has passed completely through the crossing (i.e., in the case of Pattern 3 described above), then immediately a warning activation signal is outputted to the warning signal device 5 and a CLOSE signal is outputted to the crossing gate driving means 7 to close the crossing (Steps S202, S203). Next, the program determines whether or not the train has passed back through the crossing (Steps S204, S205), and when this is confirmed, immediately thereafter the warning activation signal to the warning signal device 5 is terminated and a OPEN signal is outputted to the crossing gate driving means 7 to open the crossing (Steps S208, S209). The sequence of steps after this point is then the same as that explained above for the case of Pattern 2.

Figure 12:
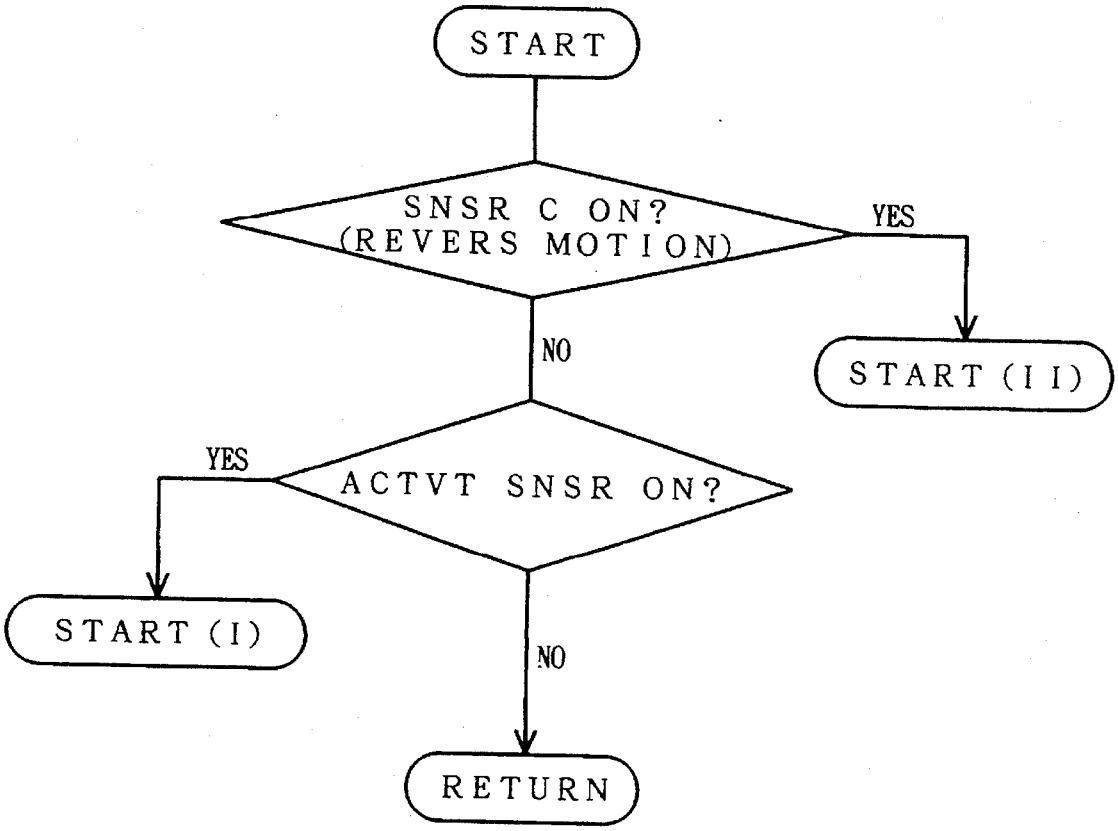
FIG. 12 illustrates a flow chart of a routine that controls the operations of the control programs of the present invention.

For the Standard Operation Program I and the Reverse Motion Operation Program II described above, every time a program operation is carried out at each program step, the routine shown in FIG. 12 is carried out. Namely, every time each program operation is carried out, the reverse motion detection device C is checked to determine whether or not it is in the ON mode, that is, whether or not the direction of motion of the train is reversed. Then when the routine determines that the direction of motion of the train has been reversed, Program II is immediately called up and its operations are carried out.

However, if the detection device C is determined to be in the OFF mode, the sensors A1, A2 are checked once again to determine whether or not they are in the ON mode, i.e., whether or not another train has entered into the crossing gate activation region A. If the sensors are determined to not be in the ON mode (i.e., they are in the OFF mode), then the routine begins again.

On the other hand, in the case where another train is determined to have entered the gate crossing activation region, the routine returns the start of Program I, and then the operations of Program I are carried out from the beginning. In the crossing gate control apparatus of the present invention, this means that the control of the gate opening and closing operations is carried out based on the most recent entry of a train into the gate crossing activation region A.

As shown in FIG. 12, the routine is carried out even during the course of Program II. Consequently, if the direction of motion of the train, whose direction of motion was initially reversed, is reversed again, Program II returns to the START position and the operations of Program II are carried out again from the beginning. As a result, by implementation of the above-described Program II, even when the direction of motion of the train is reversed a plurality of times, for example, even when the train's direction of motion is changed from left-to-right to right-to-left back to left-to-right, reliable opening and closing operations can be carried out for the train crossing. Thus, regardless of any of the reverse motion patterns encountered above, when the train does not pass through the train crossing, the crossing gate will be activated to move to the open position. Furthermore, the operations described above eliminate the possibility that a train will pass through the train crossing when the crossing gate is in the open position.

However, it should be noted that the routine shown in FIG. 12 is not carried out immediately after Step S107 of Program I and Step S207 of Program II. Instead, priority is given to the operations of the warning signal device 5 and the crossing gate driving means 7. This means that even if the direction of motion of the train is reversed, Program II starts from the beginning only after the operations of the warning signal device 5 and the crossing gate driving means 7 have been completed.

Even though the preferred embodiments of the present invention described above are directed to a railroad model having a single track, the present invention is in no way limited to single track railroad models, but instead may be applied to railroad models employing any number of railroad tracks. For example in the case of a railroad model having two tracks, the first track is provided with the train crossing activation sensors A1, A2 and the crossing sensor B as described above for the where preferred embodiments. As for the second track that runs parallel to the first track, it is also provided with the same type of train crossing activation sensors at positions corresponding to those positions of the sensors A1, A2 of the first track. Further, it is preferred that the crossing sensor B be adapted to be used for both of the two tracks. In any case, the flow charts of FIGS. 10 through 12 are equally applicable to railroad models having a plurality of tracks. Therefore, it is possible to obtain the same results described above for railroad models having any number of tracks.

Furthermore, even though the present invention was described above for use in railroad models, it is also possible to apply the present invention to train crossing control systems of actual railroads, making it possible to carry out reliable control of the opening and closing of the crossing gate when the direction of motion of a train that has passed through the crossing is suddenly reversed.

As explained above, the use of the present invention assures reliable control of the crossing gate and warning signal device. Namely, the present invention assures that when a train enters the crossing gate activation region, the crossing gate will be closed and the warning signal device will emit a warning signal, and that once the train has passed through the crossing, the crossing gate will be opened and the warning signal will be terminated. Furthermore, the present invention assures that the crossing gate will not remain closed if the direction of motion of a train that has entered the crossing gate activation region is reversed before the train passes into the crossing, and also assures that the crossing will not remain open if the direction of motion of the train is reversed after the train has passed completely through the crossing. As a result, it is possible to obtain a railroad model equipped with a novel crossing gate control system that comes the closest to giving the feel of the operations of real railroads.

What is claimed is:

1. A model railroad crossing system, comprising:

a model railroad track section including rails and a case for supporting the rails thereon; and a train detection device disposed inside said case between the rails for detecting the approach or passage of a model train running on the rails without directly contacting with the train, said train detection device including a capacitance sensor for detecting the approach and passage of the train by detecting changes in capacitance produced by changes in distance between the capacitance sensor and the train; and the capacitance sensor including a generally flat, elongated detection electrode disposed within the case and between the rails, and extending generally parallel to the rails.

2. A model railroad system as claimed in claim 1, wherein said capacitance sensor further includes a generally flat, elongated reference electrode extending generally parallel to the detection electrode, and an insulating means provided between the detection electrode and the reference electrode.

3. A model railroad system as claimed in claim 1, wherein said capacitance sensor further includes:

a reference electrode disposed in generally parallel proximity to the detection electrode; and electronic circuit means mounted on a circuit substrate and coupled to the detection electrode and to the reference electrode for measuring a difference between a capacitance in the detection electrode and a capacitance in the reference electrode for detecting the approach and passage of the train.

4. A model railroad system as claimed in claim 3, wherein said capacitance sensor further includes:

a metallic plate disposed between the circuit substrate and a bottom portion of said case, the metallic plate being electrically insulated from the circuit substrate and from the case, and arranged so as to form a first condenser between the circuit substrate and the metal plate, and a second condenser formed between the metal plate and the bottom portion of the case, whereby the first and second condensers are disposed in series, thereby reducing variations in operation of the electronic circuit means.

* * * * *